US005445349A

United States Patent [19]

Hart

[11] Patent Number: 5,445,349

[45] Date of Patent: Aug. 29, 1995

[54] WRIST SUPPORT SYSTEM

[76] Inventor: Sandra A. Hart, 3713 Morse Ave. #12, Sacramento, Calif. 95821

[21] Appl. No.: 233,921

[22] Filed: Apr. 26, 1994

[51] Int. Cl.[6] ..... B68G 5/00

[52] U.S. Cl. ..... 248/118; 400/715

[58] Field of Search ..... 248/118, 118.1, 118.3, 248/918; 5/421, 648; 400/715

[56] References Cited

U.S. PATENT DOCUMENTS

| | | | |
|---|---|---|---|
| 4,043,330 | 8/1977 | Bansal | 248/118 |
| 4,783,866 | 11/1988 | Simmons | 5/421 X |
| 4,887,326 | 12/1989 | O'Brien | 5/421 X |
| 5,125,606 | 6/1992 | Cassano | 400/715 X |
| 5,131,614 | 7/1992 | Garcia | 248/918 X |
| 5,158,255 | 10/1992 | Fuller | 248/118 |
| 5,163,646 | 11/1992 | Engelhardt | 248/118 |
| 5,165,630 | 11/1992 | Connor | 248/118.1 |
| 5,173,979 | 12/1992 | Nennhaus | 5/648 |
| 5,228,655 | 7/1993 | Garcia | 248/118 |
| 5,335,888 | 8/1994 | Thomsen | 248/118.1 X |

*Primary Examiner*—J. Franklin Foss
*Attorney, Agent, or Firm*—Mark C. Jacobs

[57] ABSTRACT

A wrist support apparatus for a person who performs activities requiring repetitive movement of the person's fingers which apparatus includes an elongated, flexible container of cloth and particulate material such as rice disposed within the interior of a tubular-shaped segment. The apparatus provides stable support for the wrist(s) and cooperates with each wrist to gently massage the wrists during finger movement. In addition, the apparatus can be cooled or heated to provide additional therapeutic effects during use. The invention also encompasses a method of employing the wrist support apparatus.

25 Claims, 2 Drawing Sheets

WRIST SUPPORT SYSTEM

FIELD OF THE INVENTION

This invention relates to an apparatus for supporting the wrists of a person performing activities, such as typing, data entry and calculating, among others, all of which require repetitive movement of the person's fingers. The apparatus of this invention relieves physical stress which can be occasioned by such activities. The invention also encompasses a method of relieving physical stress caused by repetitive movement of a person's fingers.

BACKGROUND OF THE INVENTION

It is well known that repetitive finger motion, such as that employed when typing on a computer keyboard, using a mouse, keying on a calculator or the like, can cause a debilitating condition known as Carpal Tunnel Syndrome, as well as damage to other nerves in the human wrist. Symptoms of Carpal Tunnel Syndrome include a tingling or numbness of the hand, pain in the hand which radiates up the arm, reduced hand coordination and loss of the ability to perform manual tasks, and possible atrophying of the muscle at the base of the thumb.

A number of devices are disclosed in the prior art aimed at relieving physical stresses which can lead to the debilitating effects of Carpal Tunnel Syndrome.

Typically, such prior art devices incorporate a foam pad or cushion which provides support for wrists of a person performing activities such as keyboard operation as aforesaid. Representative of such arrangements are those shown in the following U.S. Pat. Nos. 5,183,230, issued Feb. 2, 1993, 5,228,655, issued Jul. 20, 1993, 5,170,971, issued Dec. 15, 1992, 5,163,646, issued Nov. 17, 1992, 5,158,255, issued Oct. 27, 1992, and 5,125,606, issued Jun. 30, 1992.

One common drawback of such arrangements is that the shapes of the various aides cannot readily be modified. For example, it is difficult if not impossible to change the height of the user's wrists relative to a work station's support surface. Furthermore, depending upon the nature of the foam and in some cases the cover therefore, the support can be relatively stiff and non-compliant to the user's wrists. Others employ coverings or are made of rubber which cause the user to perspire.

Furthermore, in contrast to the present invention, which will be described in detail below, there is no provision in the prior art wrist support arrangements for their heating or cooling. As will be seen below, the present invention not only cooperates with the supported wrists to provide a gentle massaging action but it also can be utilized to apply heat or cold therapy to the area of the arms in contact therewith.

The present invention utilizes particulate matter to accommodate to the shape of a user's wrists and to provide the desired wrist support. It has been generally known to employ heated or cooled material, including particulate material such as rice, in a bag, and to utilize such a construction in a static manner much as one would use a hot water bottle or ice bag to apply heat or cold to necks, shoulders and other portions of the body. However, there is no known teaching in the prior art of the use of cloth bags with particulate material therein specifically constructed and adapted for utilization as a wrist support and to relieve physical stresses which could lead to Carpal Tunnel Syndrome.

During the course of the search, in addition to the patents noted above, the following United States Patents were located: 4,795,117, issued Jan. 3, 1989, which discloses and claims a steadying platform for a bottle including a bag with particulate material therein; 4,788,916, issued Dec. 6, 1988, which discloses and claims a pouch tray including a cushion with a lightweight flowable granular material such as styrofoam therein; and 4,088,127, issued May 9, 1978, which discloses and claims a massage appliance which can be fitted onto the hand, a portion of the appliance being filled with fluid which can be heated or cooled.

SUMMARY OF THE INVENTION

The apparatus of the present invention is adapted to support the wrist(s) of a person who performs activities which require repetitive movement of the person's fingers and for relieving physical stress occasioned by such activities.

It includes a flexible container, which has ends closing a generally tubular-shaped segment to define a closed interior which for a keyboard wrist rest is more elongated than the embodiment to be used with a mouse or calculator.

Particulate material is disposed within the closed interior of the flexible container in the generally tubular-shaped segment thereof. The particulate material within the closed interior is relatively movable within the confines of the container whereby upon application of outside pressure by a user's wrists the flexible container is caused to generally conform to the shape of the user's wrist(s) and to provide support for same while the user is performing activities requiring finger movement. The apparatus cooperates with the wrist(s) to gently massage the wrist(s) during the finger movement.

It is an object of this invention to provide a flexible wrist rest for use with a computer keyboard, computer mouse or an electronic calculator.

It is another object to provide a wrist rest that is filled with distinct granules of particulate matter.

It is still another object to provide a wrist rest that has an exterior cover disposed over an interior portion.

It is yet another object to provide a wrist rest that can be heated or cooled as may be desired to provide therapy to the user.

It is yet another object to provide a wrist rest that has an inner and outer layer of material such that the outer layer can be readily washed to remove soil.

Other objects of the invention will in part be obvious and will in part appear hereinafter.

The invention accordingly comprises the device possessing the features properties and the relation of components which are exemplified in the following detailed disclosure and the scope of the application of which will be indicated in the appended claims.

For a fuller understanding of the nature and objects of the invention reference should be made to the following detailed description, taken in conjunction with the accompanying drawings.

DESCRIPTION OF THE PREFERRED EMBODIMENT

The apparatus of the present invention is one adapted to support the wrist(s) of a person who performs activities which require repetitive movement of the person's fingers and for relieving physical stress occasioned by such activities.

The apparatus includes a flexible container, which for a keyboard wrist rest is elongated, constructed of flexible sheet material and includes a generally tubular-shaped segment which has ends closing the generally tubular-shaped segment to thereby define a closed elongated interior portion.

The apparatus to be employed for use with a calculator or mouse, for resting the wrist, while somewhat elongated and of similar construction, more closely resembles a rectangle or mini-pillow, than a long tube. The height to width ratio of the apparatus for mouse or calculator use is about 2.5' and about 6" wide by 8" in length.

Suitable flexible sheet materials for the outer covering are preferably those that can be machine washed. These include cloths such as cotton, flannel, percale, muslin, terry cloth, velour among others. The outer cover cloth should not induce the user to perspire, as can happen if a smooth vinyl is employed. Since the outer cover will be exposed to dirt and grime, it is preferred that the material employed be at least hand washable.

Suitable materials for the interior main member include but are not limited to cotton percale, muslin, and flannel; rayon, and other sheet fabrics. It is recommended, however, that synthetic fabrics not be employed should the user want to utilize hot therapy as described below, because repetitive microwave heating will cause the fabric to disintegrate.

Particulate material comprised of a plurality of discrete particulate elements is disposed within the closed interior of the flexible container in the interior portion thereof. The discrete particulate elements within the elongated, closed interior are relatively movable within the confines of the elongated, flexible container upon application of outside pressure to the generally tubular-shaped segment by a user's wrists. The application of pressure causes the flexible container to generally conform to the shape of the user's wrist(s) and to provide support for same while the user is performing activities requiring finger movement. For mouse or calculator usage, the same conformance takes place, but for only one wrist. The apparatus cooperates with the wrists to gently massage the wrists during the finger movement.

In the disclosed preferred embodiment, the particulate material comprises grains of uncooked rice. Other particulates have also been tried some of which work almost as well as the rice, others of which are either inferior to rice or are unacceptable.

Figure 2:
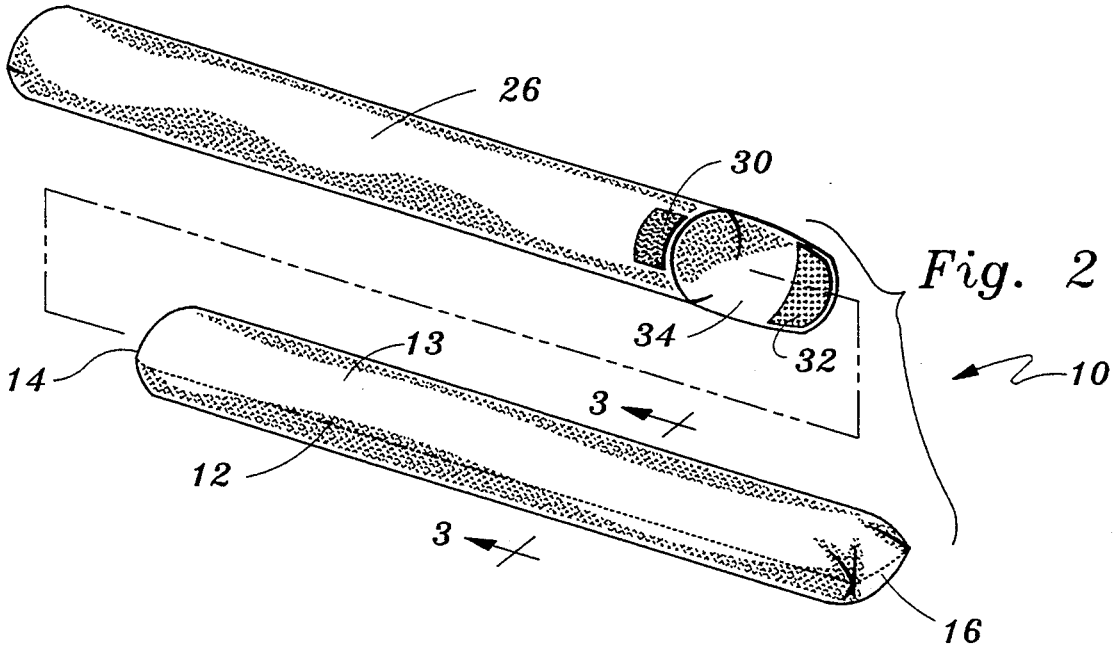
FIG. 2 is an exploded perspective view of the apparatus.

As shown in FIG. 2, the apparatus in its first embodiment suitable for use with a keyboard, and designated 10 includes an elongated, flexible container constructed of cloth such as muslin, flannel, terry cloth or other fabrics deemed suitable. The container 10 includes a generally tubular-shaped inner portion 12 having a folded over main member 13, with its ends 14, 16 closing the generally tubular-shaped inner portion and defining therewith an elongated, closed interior 18. The elongated flexible aspect of the container is formed by folding an elongated flat sheet of cloth to bring the edges thereof together followed by sewing the longitudinal edge. The closed ends are formed by sewing the generally tubular-shaped segment at its opposed ends.

Interior 18 is filled with particulate material in the form of discrete grains of uncooked rice 20 or other particulate or suitable mixtures thereof as shown in the table below prior to the closure of one of the two ends.

Apparatus 10 also utilizes a removable outer cover 26, also formed from a cloth such as one of the types of cloths suitable for forming the tubular-shaped inner portion 12. The cover 26 is formed in like manner with only one end sewn shut. Cover 26 should be dimensioned slightly larger in cross-section to readily receive the tubular-shaped inner portion 12 and not impede removal of the tubular-shaped portion 12 from the outer cover when desired. The outer cover 26 can be washed or dry-cleaned when desired. If desired, fastener material of the hook and eye type, such as Velcro ® material may be applied as patches 30, 32 to secure a flap 34 in closed condition. A zipper of suitable material can also be used to achieve the same result.

Figure 5:
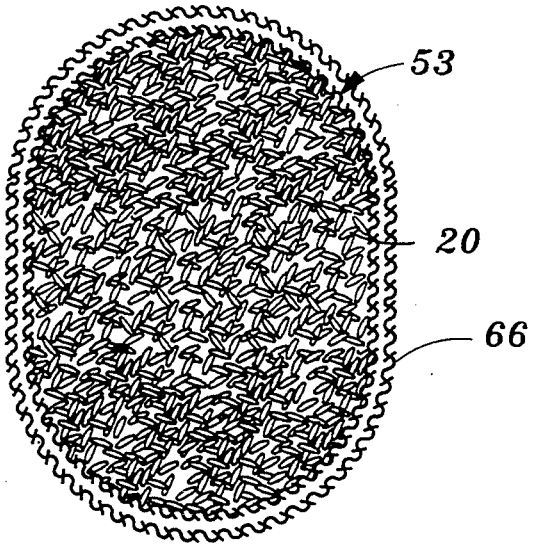
FIG. 5 is an enlarged cross-sectional view taken along line 5—5 of FIG. 4, and showing a second particulate filling.

In FIG. 5 there is shown the container 40 which is suitable for use during the operation of a mouse or calculator. Here the elongated inner portion 52 has a main tubular member of cloth 53 closed off at each of its two ends 54, 56. As with the keyboard unit, the second end is not sewn until the particulates have been added to the desired level. An outer cover 66 open at one end, and optionally closeable by a flap 71, having an engaging surface 72 for contact with an opposite engaging member 70 on the cover 66 may be employed. Wrist rests for keyboard usage were constructed using the following particulate fillers, with the results as indicate:

| PARTICULATES TESTED | | | |
|---|---|---|---|
| 01 | SPLIT PEAS | 1.73 LBS. = 4 CUPS | WORKS WELL |
| 02 | RED KIDNEY BEANS | 2 LBS. = 4 CUPS | TOO LUMPY |
| 03 | CORN MEAL | 2 LBS. = 6 CUPS | CAKED UP |
| 04 | MILLET | 1.88 LBS. = 4 CUPS | WORKED WELL |
| 05 | LENTILS | 1.86 LBS. = 4 CUPS | WORKED WELL |
| 06 | PINTO BEANS | 2 LBS. = 4 CUPS | TOO LUMPY |
| 07 | WHEAT FLOUR | 1.56 LBS. = 6 CUPS | CAKED UP |
| 08 | RICE | 2 LBS. = 6 CUPS | WORKS BEST |
| 09 | WHITE BEANS | 2 LBS. = 4½ CUPS | TOO LUMPY |
| 10 | RICE & BEANS | 1 LB. 8 OZ. = 5 CUPS RICE<br>4 OZ. = 1 CUP BEANS | WORKS WELL |
| 11 | RICE & LENTILS | 1 LB. 8 OZ. = 5 CUPS RICE<br>4 OZ. = 1 CUP LENTILS | WORKS WELL |

-continued

| PARTICULATES TESTED | | | |
|---|---|---|---|
| 12 | RICE & MILLET | 1 LB. 8 OZ. = 5 CUPS RICE | WORKS WELL |
| 13 | RICE & SPLIT PEAS | 1 LB. 8 OZ. = 5 CUPS RICE<br>4 OZ. = 1 CUP PEAS | WORKS WELL |
| 14 | FLAX SEED | 1 LB. 10 OZ. = 6 CUPS | WORKS WELL |
| 15 | OAT GROATS | 1.510 lbs. = 4 CUPS | WORKS WELL |
| 16 | HARD WHEAT BERRIES | 1.785 lbs. = 4 CUPS | WORKS WELL |

Mouse rests for use with a mouse or calculator, were prepared using the same materials as in the table above, but in lesser quantities. Those materials deemed acceptable for keyboard unit use are similarly acceptable for mouse rest use as well. Those particulates deemed unacceptable are not acceptable for both applications (embodiments.) Those deemed unacceptable are seen to be either closer to a powder format, i.e., of relatively smaller particle size, or are too large.

In each instance the suitability of the particulate was determined based upon filling, with no assessment weight being given to the nature of the fabric employed for either the inner portion or the outer cover. Those fillers having one dimension of between about 1/16th inch and ⅛th inch were deemed suitable, larger dimensioned fillers such as garbanzo beans were not acceptable. Meals and flours which with very tiny particles were also deemed unacceptable.

Rice, both long, medium and short grain, has been found to be a particularly useful and appropriate particulate material for practicing the present invention especially in view of its ready availability and low cost. Caution should be exercised to not fill the flexible container with too much volume of the particulate matter. Only about 80 percent of the inner portion which ranges from about 19 inches to about 25 inches long, should be filled, in order to leave some slack for the impressions to be made by the user's wrists as will be discussed in more detail infra. Approximately 80% fill is also provided in the mouse rest units, since a wrist impression is desired for proper usage here as well.

Figure 3:
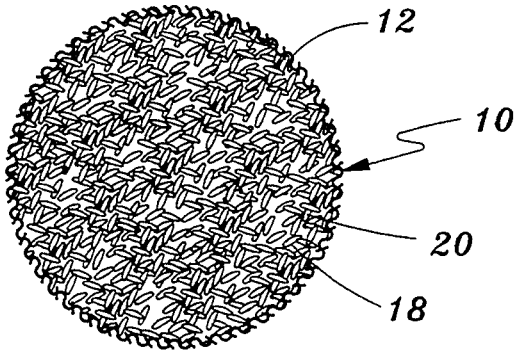
FIG. 3 is an enlarged cross-sectional view taken along line 3—3 in FIG. 2.
Figure 4:
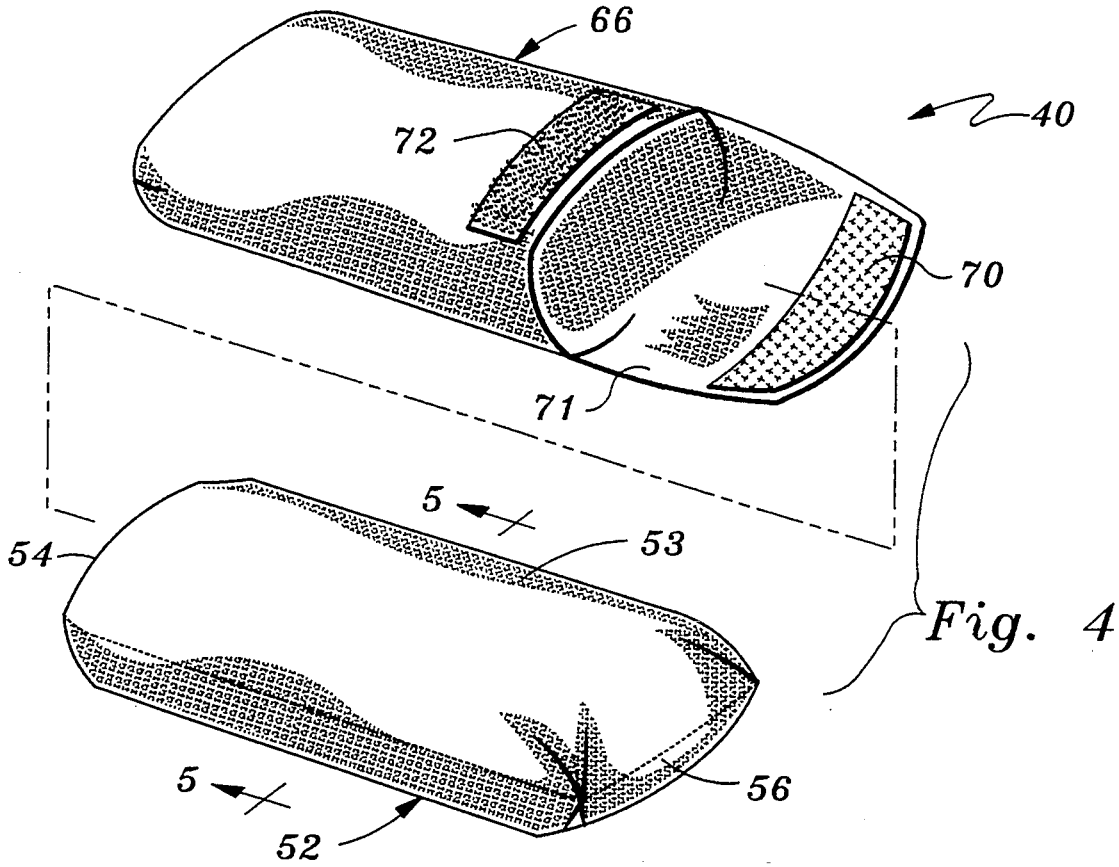
FIG. 4 is a perspective view of a second embodiment of this invention to be employed during use of a computer mouse or an adding machine.

FIGS. 3 and 5 illustrated in cross-section the packed inner portions of the first and second embodiments. In FIG. 5 the outer cover is seen, while in FIG. 3 it is not depicted.

MODE OF USAGE

Figure 1:
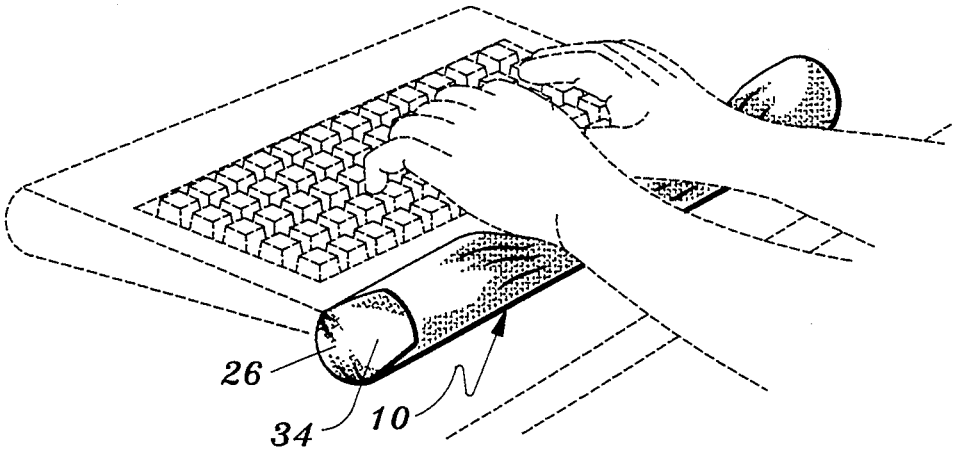
FIG. 1 is a perspective view of a preferred embodiment of the invention on a work station surface and supporting wrists of a keyboard operator.

Referring now to FIG. 1, wherein the first embodiment for keyboards designated by reference numeral 10 is seen. Apparatus 10 provides a flexible support system for the user's wrists by affording the user the opportunity to position his or her wrists in a neutral or flat position that does not hyperextend or hyperflex the wrist when the user is performing his or her tasks. This eliminates pressure on tendons and nerves while the fingers are performing repetitive movement such as those employed when typing on a keyboard, mouse or adding machine. In addition to providing wrist support at a desired location, apparatus 10 provides a gentle massage action to the user's wrists while in use and during cradling of the wrists in a comfortable position. The second embodiment, i.e., the mouse rest shown in FIG. 5 acts in like manner, specifically when one uses a mouse or electronic calculator.

The method of use of this invention includes the step of positioning an elongated, flexible container constructed of flexible sheet material, preferably in accordance with the teachings of this invention and containing particulate matter therein, on a work station surface. When using the apparatus, it is placed on a work station surface in front of the user, as shown for example in said FIG. 1. The bottom of the apparatus will flatten to conform to the shape of the work station surface. The elongated, flexible container has a primary axis which runs along the front of the work station, or stated another way, for the keyboard unit, parallel to a line running from "Z" to "M".

The user's wrists are positioned over the elongated, flexible container with the user's forearms in a direction transverse to the primary axis.

The user's wrists are brought into engagement with the elongated, flexible container with the user's forearm maintained in a direction transverse to the primary axis.

Downward pressure is exerted on the elongated, flexible container to form indents in the elongated, flexible container by dislodging and moving particulate material within the confines of the elongated, flexible container. This is possible since the inner portion is not filled to capacity as aforementioned.

The user's fingers are moved to perform a repetitive task such as typing a document, while maintaining the user's wrists in engagement with the elongated, flexible container in the indents above the work station surface and out of engagement with the wood or metal surface of the work station. See FIG. 1. The particulate material maintains the user's wrist(s) at a desired distance above the work station surface.

When rice or any suitable particulate is the particulate in the inner portion, the user's wrists exert a downward pressure on the elongated, flexible container to form spaced indents in the elongated, flexible container by dislodging and moving rice grains or the suitable particulates within the elongated, flexible container. All other suitable particulates are moved in like manner.

It has been found that the apparatus cooperates with the wrists of a person moving his or her fingers through the repetitive motions to gently massage the wrists during the finger movement.

Apparatus 10 and apparatus 40 both readily lend themselves to varying the height at which the user's wrists are deployed over the work station support surface. That is, the user before actually bringing his or her wrists into engagement with the apparatus can plump it or flatten it out by suitable manual manipulations to attain the desired wrist support elevation.

THERAPY

An important aspect of the present invention resides in the fact that the particulate material, especially those wherein it is indicated in the table that the particulate works well, may be heated or cooled to apply heat or cold to a user's wrists while the apparatus acts as a support to provide heating or cooling therapy. Heating of the apparatus can take place in a microwave oven or in a conventional oven within an oven roasting bag at low temperatures, and depending upon the potential flammability of the outer cover. The unit can be cooled by placing it in a refrigerator, but preferably in a freezer prior to use. It has been found that the apparatuses 10 and 50 employing rice and the other particulates deemed satisfactory will stay either hot or cold for approximately 15 to 20 minutes. This is important since this time span falls within the commonly recommended time limits for heat and cold therapy. The apparatus provides comfortable relief to aching wrists but is not deemed to be a cure for injury damaged wrists caused by overuse in repetitive tasks.

When a porous cloth is employed for the main member and for the outer covering when such is utilized as is recommended, in the construction of apparatus 10 and apparatus 50, a moist-type heat, which is the type of heat preferred for physical therapy purposes, will be able to be exuded by the heated apparatus to the user. The rice contains moisture which is released upon heating which moisture passes through a porous cloth. Furthermore, if desired, the user may apply to the apparatus a liquid scent, e.g., lavender; or a liquid medicament, such as eucalyptus oil, which has therapeutic properties. It is seen that while the use of a porous cloth is recommended, to be able to obtain the moist heat therapy, such a type of cloth is not required for general unheated use.

While other particulates may be heated and cooled in like manner as described herein to provide a therapeutic effect, the inherent amount of residual moisture in the rice permits it to exude some of this moisture on heating to provide a moist heat.

I found that wrist protectors filled with rice grains could be heated and reheated over 500 times in a microwave, and they still gave off moisture to the user. It is believed that retained moisture of rice will be dissipated in about two years, and cannot be re-added.

The shape of the generally tubular-shaped segment can vary somewhat, depending upon manner of use. For example, an apparatus incorporating a generally tubular-shaped portion laying flat on a table with rice evenly distributed thereon was constructed for computer keyboard use and measured 25 inches×2.5 inches×1.25 inches. Suitable exemplary apparatus for mouse use measured 6 inches×8 inches×2.5 inches. A wrist support for an adding machine operator constructed in accordance with the invention also measured 6"×8"×2.5". Other units were constructed of varying lengths, such as 9" long for a mouse rest and 18" long for a keyboard wrist rest, this last dimension being about the length of the letter portion and the numerical keyed portion of an AT type keyboard. It is also to be noted that the outer cover should be made about one inch longer than the main member.

It is seen that the use of the outer cover is only preferred and not mandatory. Its presence is intended to keep the flexible container clean. If a moist heat therapy is desired, the outer cover should be porous. If no heat therapy is desired, then the outer cover can be a synthetic fabric.

Since certain changes may be made in the above apparatus without departing from the scope of the invention herein involved, it is intended that all matter contained in the above description and shown in the accompanying drawings shall be interpreted as illustrative and not in a limiting sense.

I claim:

1. Apparatus for supporting the wrists of a person performing activities requiring repetitive movement of the person's fingers and for relieving physical stress occasioned by such activities, said apparatus comprising, in combination:

an elongated, flexible container constructed of flexible sheet material and including a generally tubular-shaped segment and ends closing said generally tubular-shaped segment and defining therewith an elongated, closed interior; and particulate material comprised of a plurality of discrete particulate elements disposed within the elongated, closed interior of said elongated, flexible container in the generally tubular-shaped segment thereof, said discrete particulate elements within said elongated, closed interior being relatively movable within said elongated, flexible container upon application of outside pressure to said generally tubular-shaped segment by a user's wrists to generally conform it in shape to the user's wrists and to provide support therefore while the user is performing activities requiring finger movement, and said apparatus cooperating with said wrists to gently massage said wrists during said finger movement.

2. The apparatus according to claim 1 wherein said flexible sheet material is cloth.

3. The apparatus according to claim 1 wherein said discrete particulate elements are grains.

4. The apparatus according to claim 3 wherein said grains selected from the group consisting of grains of uncooked rice alone and in combination with other particulates.

5. The apparatus according to claim 1 additionally comprising a removable outer cover encompassing said elongated, flexible container.

6. The apparatus according to claim 5 wherein said flexible container and said removable outer cover are formed from porous cloth.

7. The apparatus according to claim 1 wherein said elongated, flexible container generally tubular-shaped segment has a length within the range of from about 3 inches to about 25 inches.

8. The apparatus according to claim 1 wherein said apparatus with the particulate material therein is heated to a temperature above human body temperature to heat a user's wrists when supported by said apparatus.

9. The apparatus according to claim 1 wherein said apparatus with the particulate material therein is cooled to a temperature below human body temperature to cool a user's wrists when supported by said apparatus.

10. The apparatus according to claim 1 wherein said flexible material is porous, absorbent cloth and the particulate is grains of rice.

11. A method of relieving physical stress caused by repetitive movement of a person's fingers, said method comprising the steps of:

positioning an elongated, flexible container constructed of flexible sheet material on a work station surface, said elongated, flexible container having a primary axis and containing particulate material comprising a plurality of discrete particulate elements;

positioning a user's wrists over said elongated, flexible container with the user's forearms in a direction transverse to said primary axis;

bringing the user's wrists into engagement with said elongated, flexible container with the user's forearms maintained in a direction transverse to said primary axis;

exerting downward pressure on said elongated, flexible container to form indents in said elongated flexible container by dislodging and moving particulate material within said elongated, flexible container; and moving the user's fingers to perform a repetitive task while maintaining the user's wrists in engagement with said elongated, flexible container in said indents above the work station surface and out of engagement therewith, said particulate material maintaining the user's wrists at a desired distance above said work station surface.

12. The method according to claim 11 wherein said discrete particulate elements occupy about 80% of the volume available in said flexible container.

13. The method according to claim 12 wherein said grains are grains of uncooked rice.

14. The method according to claim 1 including the further step of manually manipulating said elongated, flexible container and the plurality of discrete particulate elements therein to change the configuration of said elongated, flexible container before the step of bringing the user's wrists into engagement with said elongated, flexible container to establish a predetermined distance above said work station surface at which the user's wrists initially engage said elongated, flexible container.

15. The method according to claim 11 including the step of heating said apparatus and the particulate material therein before positioning said elongated, flexible container on the work station surface whereby the user's wrists will be heated when in engagement with said elongated, flexible container.

16. The method according to claim 11 including the step of cooling said apparatus and the particulate material therein before positioning said elongated, flexible container on the work station surface whereby the user's wrists will be cooled when in engagement with the elongated, flexible container.

17. The method according to claim 11 wherein said flexible sheet material comprises porous cloth.

18. The method according to claim 17 wherein, said method additionally includes the step of applying a liquid to said porous cloth and absorbing the liquid into said porous cloth prior to use.

19. The method according to claim 11 including the step of inserting said elongated, flexible container into the interior of a removable cloth cover prior to positioning of said elongated, flexible container on a work station surface.

20. The method according to claim 11 wherein the finger movement of a user , said elongated flexible container and said particulate material cooperate to gently massage the user's wrists when in engagement with said elongated, flexible container.

21. The apparatus of claim 1, wherein the particulate elements are a mixture of rice with a member selected from the group consisting of split peas, millet and lentils.

22. The apparatus of claim 5 wherein at least one of the outer cover and the flexible container are made of muslin.

23. The apparatus of claim 5 wherein both the outer cover and the flexible container are made of muslin, and the particulate is grains of rice.

24. The apparatus of claim 1 wherein particles of the particulate filler have one dimension of between about 1/16th and ⅛th inch.

25. In the apparatus of claim 1, wherein the particulate material is capable of retaining heat or cold for about 15 to 20 minutes for delivery to the user of said apparatus.

* * * * *